United States Patent [19]

Thurman

[11] 4,027,497

[45] June 7, 1977

[54] FREEZE-UP PREVENTION DEVICE FOR A HEAT PUMP

[76] Inventor: Merrell E. Thurman, 6301 Fox Run, San Antonio, Tex. 78233

[22] Filed: Feb. 26, 1976

[21] Appl. No.: 661,728

[52] U.S. Cl. ..... 62/156; 62/275

[51] Int. Cl.[2] ..... F25D 21/06

[58] Field of Search ..... 219/538, 545; 62/275, 62/156

[56] References Cited

UNITED STATES PATENTS

| | | | |
|---|---|---|---|
| 2,459,173 | 1/1949 | McCloy | 62/275 |
| 2,630,685 | 3/1953 | Lewis | 62/275 |
| 2,709,345 | 5/1955 | Ramsey | 62/275 |
| 2,713,249 | 7/1955 | Schordine | 62/275 |
| 3,950,962 | 4/1976 | Odashima | 62/156 |

*Primary Examiner*—Lloyd L. King
*Attorney, Agent, or Firm*—Cox, Smith, Smith, Hale & Guenther Incorporated

[57] ABSTRACT

The present invention relates to heat pumps which include a freeze-up prevention device for use during the heating cycle. The heat pump consists of the normal compressor which connects by means of a four-way valve to an inside coil and an outside coil. An expansion valve and appropriate check valve allow the flow of refrigerant between the inside and outside coils. During the heating cycle, the inside coil is the condenser and the outside is the evaporator. The freeze-up prevention device is a small insertable unit immediately prior to the evaporator which allows the refrigerant to flow therethrough. The insertable unit has a heating element operable by a thermostat attached to the outside coils with the thermostat closing a switch to allow current to flow to the heating element when an icing condition is sensed. The insertable unit, via the heating element, transmits heat directly to the refrigerant thereby preventing freeze-up of the evaporator coil.

9 Claims, 4 Drawing Figures

FREEZE-UP PREVENTION DEVICE FOR A HEAT PUMP

BACKGROUND OF THE INVENTION

This invention relates to heat pumps and, more paricularly, to an insertable freeze-up prevention device immediately prior to the evaporator coil of the heat pump when operating in the heating cycle. The freeze-up prevention device has a heating element operable by a thermostat on the evaporator coil to add heat directly to the refrigerant immediately prior to entering the evaporator coil when the heat pump is in the heating cycle.

BRIEF DESCRIPTION OF THE PRIOR ART

The term "heat pump" has been used for a considerable period of time by the refrigerating and air conditioning industry to indicate a combination heating and cooling system whereby the function of the evaporator and condenser are reversed depending upon whether the system is in the heating or cooling mode of operation. This is accomplished through appropriate valving mechanisms, such as a four-way valve.

In operation during a heat cycle, a compressor will pressurize a gaseous refrigerant which is then fed into a condenser located inside of a space to be heated. The high pressure gaseous refrigerant is converted to a liquid form inside the condenser. Air flowing over the condenser will heat the space which may consist of a home or business. From the condenser, liquid refrigerant is connected to an expansion valve which allows the liquid refrigerant to flow therethrough and be released at a relatively low pressure. From the expansion valve, the low pressure liquid refrigerant flows to an evaporator coil normally located outside the space to be heated. In the evaporator coil, the liquid refrigerant is converted to a vapor by absorbing heat from the surrounding environment. From the evaporator, the vaporized refrigerant is drawn into the compressor for re-pressurization and recycling.

By the switching of a four-way valve leading to the compressor, the condenser can be switched to an evaporator, and the evaporator may be switched to a condenser. This allows the same space which was previously heated to be cooled by the coil located inside of the space. It may be necessary to have an additional four-way valve to switch the flow through the expansion valve or have two expansion valves in parallel, one allowing flow in one direction and the other allowing flow in the opposite direction.

The use of a heat pump is ideal for locations where the heating load in the winter is almost the same as the cooling load in the summer. While the outside coil may be buried in the ground, it is also quite common for the outside coil to be either heated or cooled by the atmosphere. Installations where the outside coil is heated or cooled by the atmosphere, depending on the mode of operation, are most satisfactory when the ambient air temperature in the winter remains above freezing with only occasionally dropping below the freezing point. Heat pump installations are most efficient if there is a source of water, such as a flowing well, available for use as the evaporator heat source or the condenser cooling medium.

The most common problem in the use of heat pumps is due to evaporator freeze-up during the heating cycle. Assuming that the outside coil is using the atmosphere as a heat source, once the outside atmosphere drops below freezing, the evaporator coil will have a tendency to freeze up by the collection of ice on the coil. In the past, many systems have been devised for either preventing or removing the accumulation of ice from the evaporator coil of a heat pump. One common method was to periodically reverse cycle the heat pump, even though heat may be necessary for the inside of the building. As soon as the ice was removed from the evaporator coil, the heat pump would be changed back to the heating cycle for the heating of the inside space. Another common method used to prevent the accumulation of ice on the outside evaporator coil during the heating cycle, was to have various heating mechanisms on the evaporator coil itself. These heating mechanisms would normally be controlled by either temperature sensors on the evaporator coil or frost sensors that detect an accumulation of ice on the coil. These methods were very inefficient because of the low heat transfer between the heating element and the refrigerant flowing through the evaporator coil.

SUMMARY OF THE INVENTION

It is an object of the present invention to provide a device in a heat pump system to prevent freeze-up of the evaporator coil during the heating cycle.

It is another object of the present invention to provide a heat transfer device insertable in the refrigerant flow lines immediately prior to the evaporator coil of a heat pump operating in the heating cycle, the heat transfer device raising the temperature of the refrigerant by an auxiliary heating means if ice begins to accumulate on the evaporator coil.

It is yet another object of the present invention to provide an electrical heating element immediately prior to the evaporator coil of the heat pump during the heating cycle. The electrical heating element is controlled by a thermostat attached to the evaporator coil to sense an icing condition with the heating element being inserted in an auxiliary coil for the maximum transfer of heat to the refrigerant.

It is yet another object of the present invention to provide a device insertable before the evaporator coil of a heat pump operating on the heating cycle. The device allows the refrigerant to flow therethrough with an electrical heating element being controlled by a thermostat on the evaporator coil to provide the maximum transfer of heat to the refrigerant immediately prior to the evaporator.

It is even another object of the present invention to provide a device to prevent freeze-up of the evaporator coil of a heat pump during the heating cycle. The device consists of two parallel flow passages for the refrigerant, each passage being generally arranged as a flat spiral coil with an electrical resistance heating element being sandwiched between the two passages. This allows for maximum transfer of heat from the heating element to the refrigerant flowing through the two parallel passages.

DESCRIPTION OF THE PREFERRED EMBODIMENT

Figure 1:
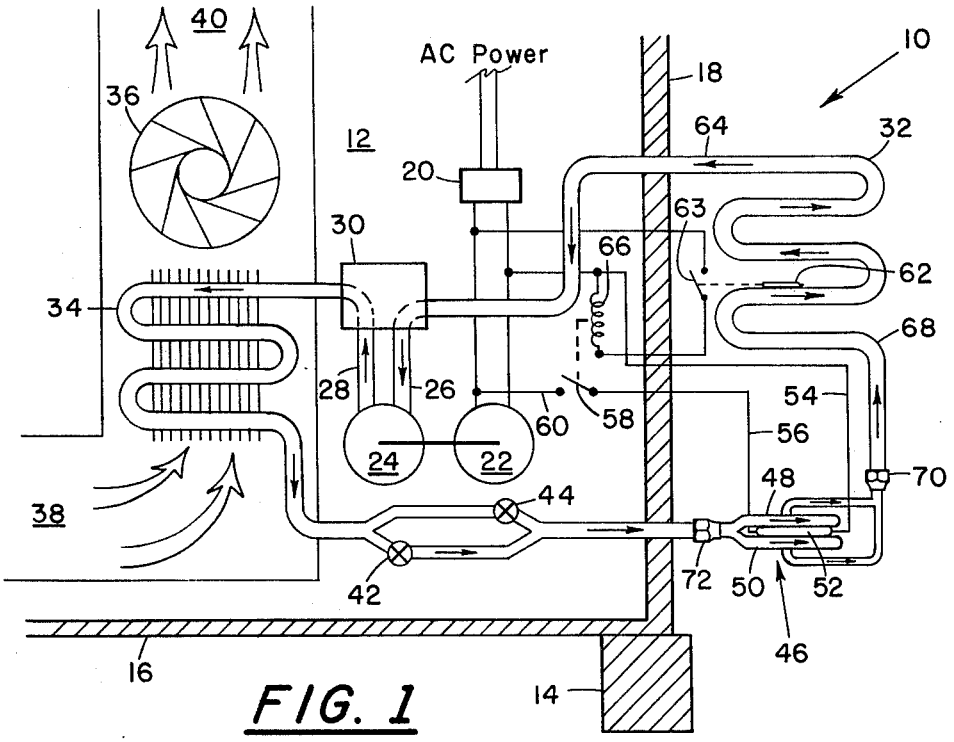
FIG. 1 is a schematic representation of a heat pump operating on the heat cycle which includes a freeze-up prevention device immediately prior to the evaporator.

Referring now to FIG. 1 of the drawings there is shown a heat pump system, represented generally by the reference numeral 10, in a schematic form. The heat pump system 10 is used both for the heating and cooling of the space 12 contained inside of the building pictorially represented by foundation 14, floor 16 and wall 18. Other portions of the building are not shown in the schematic representation of FIG. 1.

Referring now to the operation of the heat pump system 10, the heat pump is presently set for operation on the heating cycle. Power for the operation of the heat pump system is received from standard AC voltage delivered by the public utilities. The power feeds through a control box 20 which may be used to turn the heat pump system 10 ON or OFF. Assuming that the heat pump system is turned ON through the control box 20, power will be delivered to motor 22. Motor 22, through a direct coupling, is used to drive compressor 24. Inlet line 26 allows a vaporized refrigerant, such as Freon, to flow into compressor 24 for pressurization and subsequent flow from compressor 24 through outlet line 28. Both the inlet line 26 and the outlet line 28 connect through four-way valve 30. In the configuration shown in FIG. 1, four-way valve 30 connects the inlet line 26 to the outside coil 32, and the outlet line 28 to the inside coil 34. For the purposes of the present invention, the outside coil will be referred to as the evaporator and the inside coil 34 will be referred to as the condenser; however, the function of the outside coil 32 and inside coil 34 could be reversed by the four-way valve 30 whereby the inside coil 34 would become the evaporator and the outside coil 32 would become the condenser to correspond to the cooling cycle for the heat pump system 10.

A fan 36 draws air through inlet passage 38, over the condenser coil 34 for the absorption of heat, with subsequent discharge through heating ducts 40. In the condenser 34, the high pressure vaporized refrigerant is condensed by giving off heat to the air drawn thereacross by the fan 36. The refrigerant flowing from condenser 34 is at a high pressure liquid state.

From the condenser 34, the high pressure liquid refrigerant flows through expansion valve 42 in the direction indicated by the arrow. Expansion valve 44, which is in parallel with expansion valve 42, will allow flow in the opposite direction during the cooling cycle of the heat pump system 10. It is possible to use only one expansion valve by the use of a four-way valve similar to four-way valve 30.

From the expansion valve 42, a low pressure liquid refrigerant is delivered to freeze-up prevention device 46. The freeze-up prevention device consists of two parallel passages 48 and 50 arranged in a manner as will be subsequently described in more detail in conjunction with FIGS. 2 through 4. Between the parallel passages 48 and 50, is located a heating element 52, which may be of the normal resistance heating type. The heating element 52 is connected through wire 54 to one side of the AC input for motor 22. The other side of the heating element 52 is connected through wire 56 to switch 58. The other side of switch 58 is connected through wire 60 to the other input for motor 22. Connected between the two inputs for motor 22, is a thermostat switch 63 that will close if the temperature of the evaporator coil 32 drops below a predetermined point with a thermostat bulb 62 operating the thermostat switch 63. The closing of the thermostat switch 63 allows a current to flow through coil 66 connected in series therewith. Current flow through coil 66 will close switch 58. The closing of switch 58 will allow a current to flow through heating element 52, thereby causing heating element 52 to give off heat that is absorbed by the refrigerant flowing through parallel passages 48 and 50.

From the freeze-up prevention device 46, the refrigerant will flow through line 68 to the evaporator 32. In evaporator 32, heat is absorbed from the surrounding environment to cool the refrigerant as it evaporates. From evaporator 32, the refrigerant is drawn through evaporator line 64, four-way valve 30 and inlet line 26 into compressor 24 for repressurization. The pressure in evaporator line 64 is commonly referred to as the suction pressure of the compressor 24.

It should be understood that the freeze-up prevention device 46 is easily installed in line 68 from the expansion valve 42 to the evaporator 32 by means of connectors 70 and 72. Since the freeze-up prevention device is only used during cold weather, normally at or below the freezing point, an individual may install the freeze-up prevention device only during the winter months by connectors 70 and 72 and the electrical connections via wires 54 and 56. Another method that may be utilized, without the necessity of connecting and disconnecting the freeze-up prevention device 46, is to simply include a four-way valve that connects both sides of the freeze-up prevention device 46 into the system only if freeze-up conditions are sensed by thermostat switch 63. Otherwise, flow can go directly from expansion valve 42 via line 68 to evaporator 32.

If during the heat cycle of the heat pump system 10 ice begins to accumulate on evaporator 32, the temperature of the evaporator coil 32 will have dropped below freezing causing the thermostat bulb 62 to close the thermostat switch 63. The normal set point for the thermostat bulb 62 and thermostat switch 63 is approximately 32° Fahrenheit. Therefore, if the thermostat switch 63 is set for 32° Fahrenheit, this will be an effective set point for most air conditioning systems. There is also a direct relationship between drops in suction pressure and the freeze-up of the evaporator coil of a heat pump system operating in the heating cycle, which relationship may also be used to control coil 66.

Figure 3:
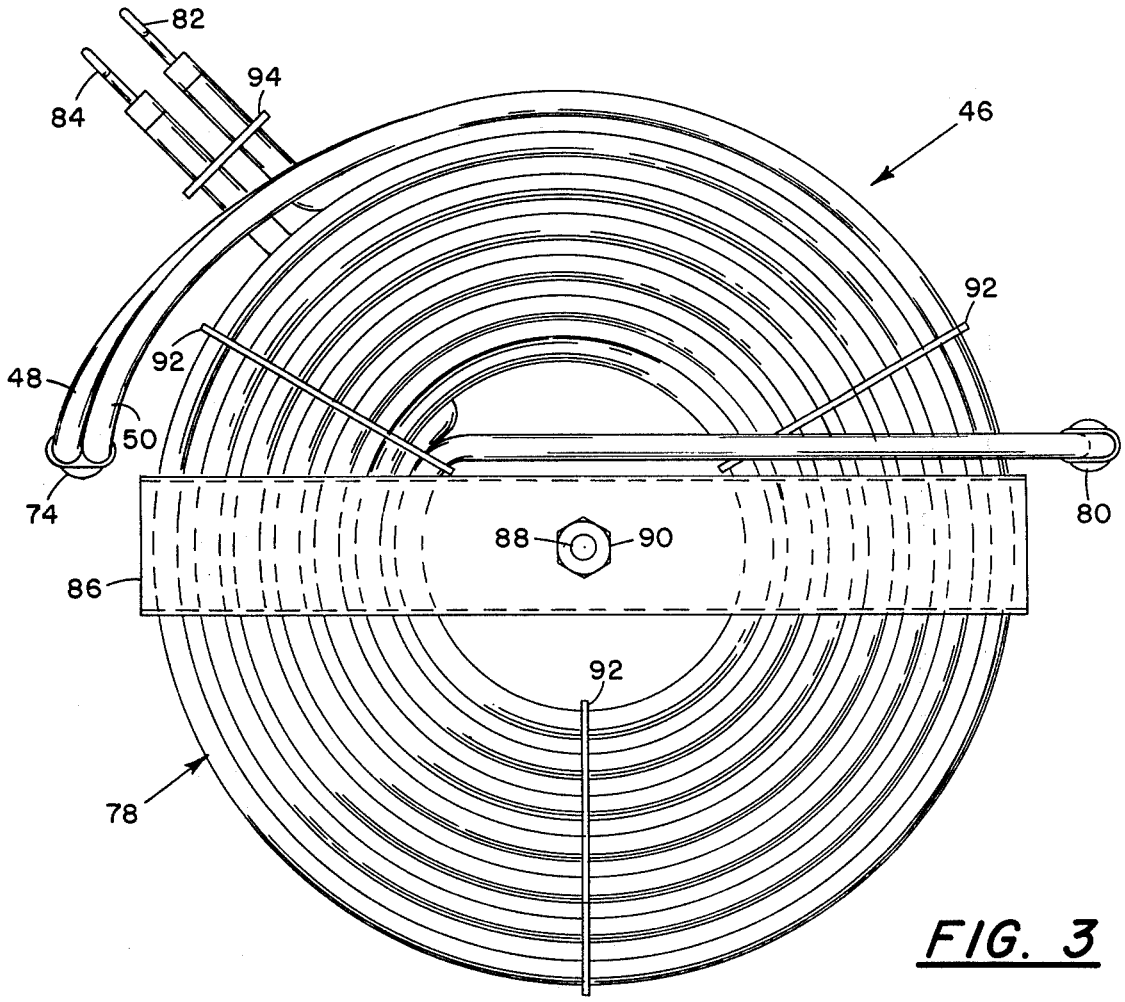
FIG. 3 is a bottom view of FIG. 2.
Figure 4:
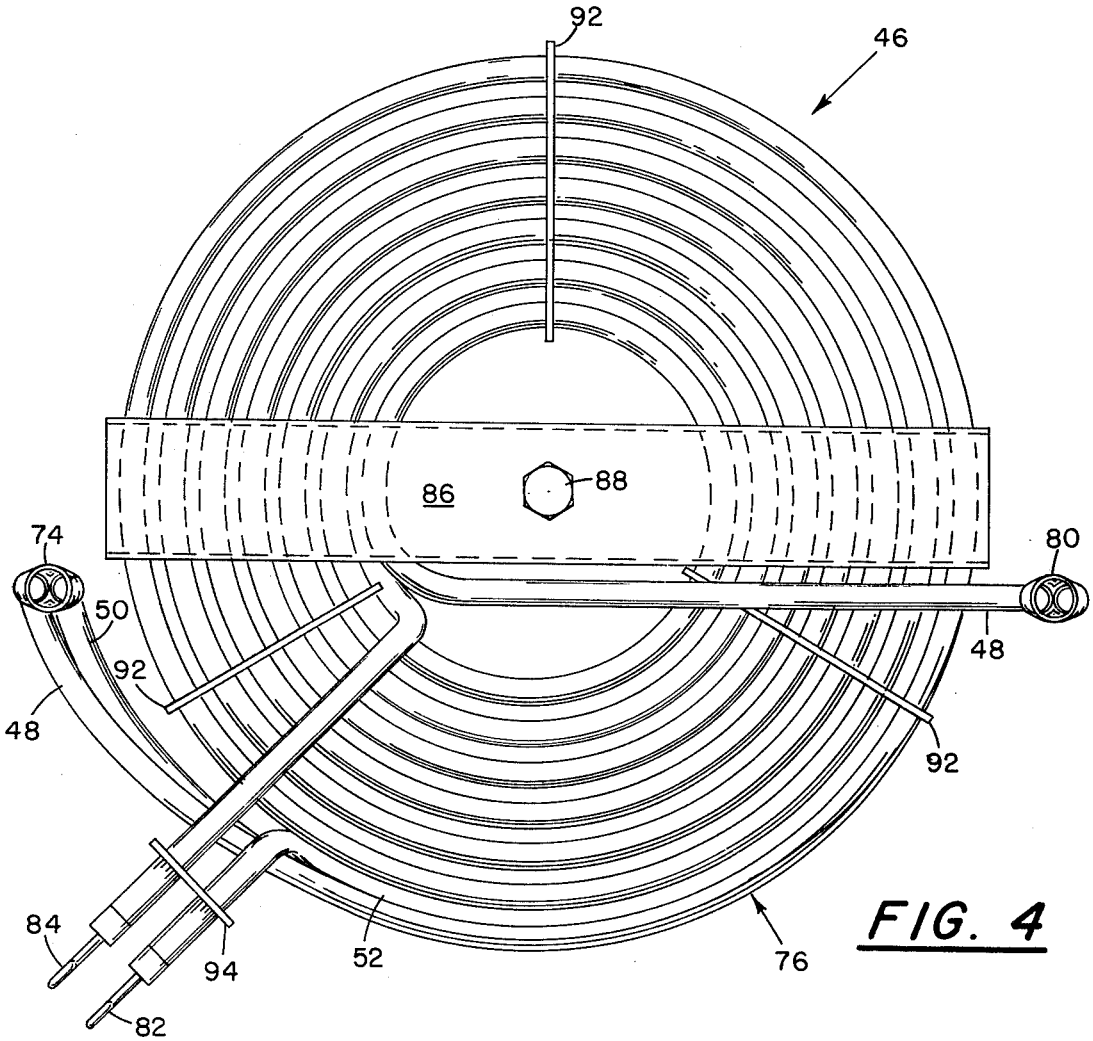
FIG. 4 is a top view of FIG. 2.
Figure 2:
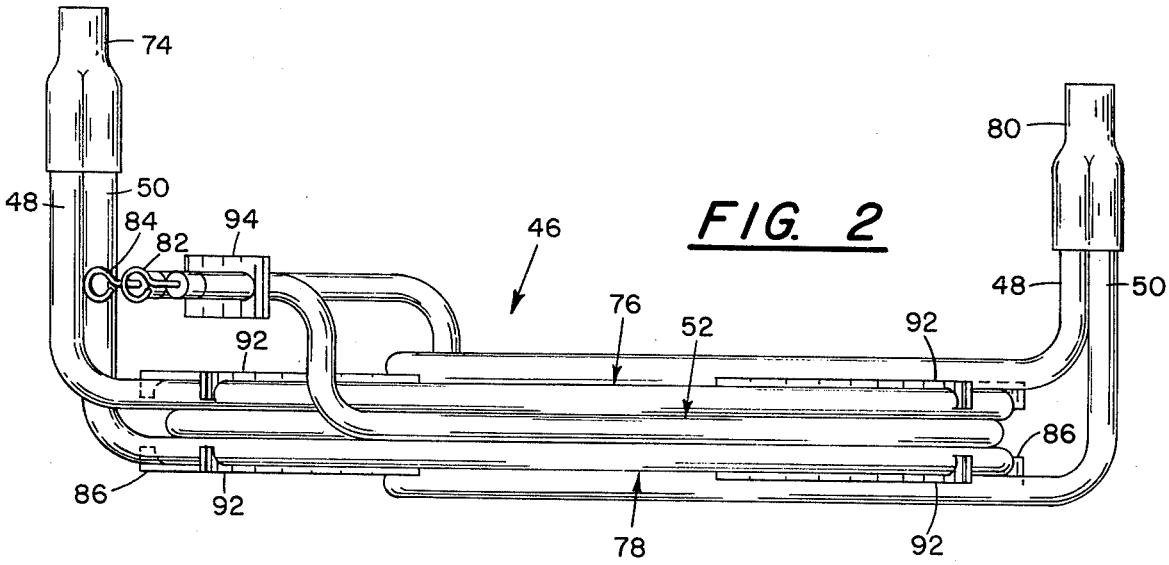
FIG. 2 is an elevated side view of a freeze-up prevention device as schematically shown in FIG. 1.

Referring now to FIGS. 2, 3 and 4 in combination, the structure of the freeze-up prevention device 46 is explained in more detail. The line from the expansion valve 42 connects through fitting 74 to parallel passages 48 and 50. Parallel passages 48 and 50 both form spiral shaped coils 76 and 78, respectively. Sandwiched between the spiral shaped coils 76 and 78 is the heating element 52, which also has a spiral shaped configuration. From the center of the spiral shaped coils 76 and 78, parallel passages 48 and 50, respectively, extend to fitting 80 which converges the two parallel passages 48 and 50 into line 68 leading to evaporator 32. Wires 54 and 56 are connected to the heating element 52 by means of terminals 82 annd 84. It does not matter which terminal, 82 or 84, is attached wire 54 or 56.

To hold the spiral shaped coils 76 and 78 over the heating element 52, which is also spiral shaped and sandwiched in between, is bracket 86 held by bolt 88 and nut 90. To insure proper spacing of the spiral shaped coils 76 and 78, a series of spacers 92 are periodically located around the spiral shaped coils 76 and 78. The two terminals 82 and 84 for the heating element 52 are held in a spaced apart relationship in insulating clamp 94.

It should be understood that the freeze-up prevention device 46, as has been described in conjunction with the heat pump system 10, is only necessary near or below freezing to prevent the collection of ice on the evaporator 32.

I claim:

1. A heat pump system for alternately heating and cooling a given space, said system comprising:

a source of power;

a compressor driven by the source of power, said compressor having an inlet and outlet;

valve means connecting to said inlet and outlet;

inside coil located within said given space;

outside coil located outside said given space; said valve means connecting said inlet to said inside coil and said outlet to said outside coil for cooling, and alternatively connecting said inlet to said outside coil and said outlet to said inside coil for heating, said inside and outside coils being adapted to receive a refrigerant from said compressor;

expansion valve means connected to said inside coil for allowing said refrigerant to flow therethrough, said refrigerant being at a high pressure liquid state on one side of said expansion valve means and at a low pressure liquid state after flowing through said expansion means;

sensing means for sensing freeze-up conditions on said outside coil;

freeze-up prevention means disposed between said expansion valve means and said outside coil for receiving said refrigerant therethrough, said freeze-up prevention being responsive to said sensing means upon sensing said freeze-up conditions to connect a heating element to said source of power for adding heat to said refrigerant if ice begins to accumulate on said outside coil during heating of said given space, said heating element being generally pie-shaped and sandwiched between parallel, generally pie-shaped conduit means from said expansion valve means for maximum heat transfer thereto.

2. The heat pump as given in claim 1 wherein said heating element is of an electrical resistance type, said sensing means closing switch means to allow current received from said source of power to flow through said heating element.

3. The heat pump as given in claim 2 further including a solenoid means connected to said sensing means, said solenoid means closing said switch means upon current flow therethrough.

4. A freeze-up prevention device for use with a heat pump system having a source of electrical power, a source of refrigerant, an expansion valve, a condenser coil and an evaporator coil, said heat pump system having a heating and cooling cycle, said freeze-up prevention device comprising:

first connector means for receiving refrigerant from said expansion valve;

parallel conduit means connected to said first connector means to receive refrigerant therefrom, said parallel conduit means being of a generally flat spiral shape in a spaced apart relationship;

resistance heating element located in said space between said parallel conduit means;

second connector means for connecting said parallel conduit means to said evaporator coil to allow refrigerant to flow thereto;

switching means for connecting said resistance heating element to said electrical power source; and sensor means for detecting ice accumulation on said evaporator coil, said sensor means controlling operation of said switching means, current flow through said switching means and to said resistance heating element thereby causing heat to be absorbed from said resistance heating element by refrigerant flowing through said parallel conduit means.

5. The freeze-up prevention device as given in claim 4 wherein said resistance heating element is of a generally flat spiral shape so that space between said parallel conduit means is minimum for a maximum heat transfer to the refrigerant upon current flow through said resistance heating element.

6. The freeze-up prevention device as given in claim 5 wherein said sensor means includes a control switch adapted to close if temperature of said evaporator coil drops below a predetermined point, closure of said control switch providing said control of said switching means.

7. The freeze-up prevention device as given in claim 6 wherein said closure of said control switch allowing current to flow through a solenoid, flow of current through said solenoid controlling said switching means.

8. The freeze-up prevention device as given in claim 4 wherein said first and second connector means are hand operable for ease of installation of said freeze-up prevention device.

9. The freeze-up prevention device as given in claim 5 further including a clamp means for holding said flat spiral shaped parallel conduit means and resistance heating element in a flat abutting relationship.

* * * * *